US005156494A

United States Patent [19]

Owens et al.

[11] Patent Number: 5,156,494

[45] Date of Patent: Oct. 20, 1992

[54] MOISTURE STABILIZATION CONTROL SYSTEM FOR FOUNDATIONS

[75] Inventors: Steven C. Owens, Katy; Gary L. Sizenbach, Spring, both of Tex.

[73] Assignee: Darien Management Co., Inc., Spring, Tex.

[21] Appl. No.: 737,075

[22] Filed: Jul. 26, 1991

[51] Int. Cl.[5] ..... E02B 11/00

[52] U.S. Cl. ..... 405/229; 73/786; 340/690; 52/302; 405/258; 405/36

[58] Field of Search ..... 405/230, 229, 258, 36, 405/43; 52/169.1, 169.14, 169.05; 73/784, 786; 340/690

[56] References Cited

U.S. PATENT DOCUMENTS

| | | | |
|---|---|---|---|
| 3,673,861 | 7/1972 | Handy | 73/784 X |
| 4,503,710 | 3/1985 | Oertle et al. | 73/786 X |
| 4,794,797 | 1/1989 | Ogawa | 73/786 |
| 4,879,852 | 11/1989 | Tripp | 405/258 X |
| 4,962,668 | 10/1990 | Preston et al. | 73/784 |
| 4,995,764 | 2/1991 | Connery et al. | 405/229 |

*Primary Examiner*—Dennis L. Taylor
*Attorney, Agent, or Firm*—Cox & Smith Incorporated

[57] ABSTRACT

The present invention is a moisture stabilization control system used to prevent structural damage to foundations resulting from forces exerted by the expansion and contraction of underlying soil. Stress sensors are employed to monitor the stress applied against the foudnation. When abnormal amounts of stress are sensed by the system, it compensates for the decreased support of the foundation by injecting water into the soil supporting that foundation until the level of stress is equalized and at the proper amount. The present invention is designed such that it can provide water to the soil in specified zones, thereby relieving localized depletions and preventing substantial structural damage to any foundation.

16 Claims, 8 Drawing Sheets

C1
0.1MFD
+5VDC
+5VDC
47
(P2-D4)
-ON/OFF 1
(P4-C2)
FAULT
U1
CD4001
R1
2.7K
Q1
U2
MOC3011
NC
48
R3
2k
49
(P3-AB)
S1
C3
0.1MFD
R4
1K
Q2
2N6066
J2
(P2-D4)
-ONOFF 2
81
R1
2.7K
Q3
+5VDC
50
(P3-AB)
S1
85
(P2-D4)
-ON/OFF 3
82
R13
2.7K
Q5
51
86
(P2-D4)
-ON/OFF 4
83
R14
270
Q7
BCX70K
52
(P3-AB)
S4
Q8
2N6066
87
(P2-D4)
-ON/OFF 5
84
R18
270
Q9
BCX70K
53
(P3-AB)
S5
Q10
2N6066
88
(P3-C8)

MOISTURE STABILIZATION CONTROL SYSTEM FOR FOUNDATIONS

BACKGROUND OF THE INVENTION

1. Field of the Invention

The present invention relates to an apparatus for stabilizing soil and reducing the possibility of structural damage to foundations used to support buildings and dwellings. More particularly, this invention relates to an apparatus for controlling soil moisture content to stabilize forces being exerted against foundations by soil which expands and contracts in relation to its moisture content.

2. Description of the Prior Art

The expansion and contraction of clay soils has resulted in billions of dollars of damage to building foundations. Soils containing clay expand and contract as moisture content changes. Soils with a high content of certain clays can shrink to half their original volume as they relinquish water and dry out from their saturated state. A foundation constructed on those types of soil will experience varying structural loads when the soil expands and contracts. In geographical areas with a wide variation in seasonal precipitation, soil expansion and contraction will cause bending forces in a foundation that cause damage and possibly lead to structural failure.

Another problem occurs when one section of the soil underneath the foundation experiences localized moisture deprivation. Localized depletion is created by the existence of vegetation around a foundation. For example, the roots of a tree present near the foundation will absorb moisture from that specific area causing a localized depletion of soil moisture content. When that occurs, the soil contracts causing that particular foundation section to sag. That, in turn, creates unequal load stress about the entire foundation resulting in structural failure. Traditionally, piers have been installed after structural damage to prevent the foundation from further movement. However, in many instances piers may not be a permanent solution, and they are costly to the homeowner.

Systems have been developed which attempt to maintain the soil at a constant level of moisture. The aim is to prevent wet-dry cycles and thereby prevent the volume changes in soil that cause foundation damage. One such system is disclosed in U.S. Pat. No. 4,534,143 issued to Goines et al. The system of Goines et al. operates to supply water to the soil surrounding a foundation to produce a stable soil moisture level and prevent foundation stress. However, the fact that the Goines et al. system can only add water in preset amounts and at preset times is a serious drawback. It will continue to add water during rainy periods and can worsen the puddling of water around a foundation. Conversely, when hot, dry periods occur, the preset water is inadequate to stabilize the moisture content which can lead to serious soil shrinkage and foundation damage. Furthermore, the Goines et al. system cannot compensate for localized moisture depletion as might be caused by a large tree. The overlying foundation can experience a downward deflection into the localized area of decreased support and damage a foundation despite the presence of the functioning watering system. Even at its best, the Goines et al. system demands sound judgment about weather and its affects causing frequent adjustment by the system's owner.

An improvement over the Goines et al. system is disclosed in U.S. Pat. No. 4,878,781 issued to Gregory et al. The Gregory et al. system addresses the problem of seasonal changes by installing a flow regulator preset to a relatively high flow of water during hot and dry seasons and a relatively low flow of water for cooler and less dry seasons. However, the Gregory et al. system provides only for seasonal changes and still relies upon human judgment and frequent resetting for foundation protection. As with Goines et al., hazards remain from the potential for too much or too little water.

Another system that addresses the problem of localized soil moisture depletion is disclosed in U.S. Pat. No. 4,879,852 issued to Tripp. That system provides water to the soil underneath the foundation on a demand basis and also provides for a localized dispersion of water. Additional water can, therefore, be supplied to those areas that are lacking, such as those near plants and vegetation, without wasting water on those areas sufficiently hydrated. The Tripp system uses a series of moisture sensors placed beneath the surface of the soil to determine the localized water depletion. A control box containing an electronic processor located near the foundation receives and processes the signals from the moisture content sensors. After the moisture content of various areas around the foundation has been determined, water is introduced into those areas based upon the amount of dehydration. The electronic processor controls various sets of control valves to allow water to flow to each of the areas until the selected water content of that area has been met. The control valves are then closed by the electronic processor until water is again needed.

Although the Tripp system is said to be more effective than previous systems, it will not be in clay-based soils. In clay, conventional moisture content sensors are subject to serious measurement inaccuracies, often greater than plus or minus 50%. These occur because most conventional moisture content sensors measure the dielectric constant of the water in comparison to the dielectric constant of the surrounding soil in order to determine the overall moisture content of the soil. Specifically, measurement inaccuracies in clay occur because the dielectric constant of water is approximately 80 and the dielectric constant of clay ranges in the magnitude of $10^6$ through $10^7$. Determining changes in the dielectric constant of water as measured against the dynamic range of the dielectric constant of clay is difficult and prone to produce inaccurate results. The available technology for the precise moisture measurement in clay is cost-prohibitive to most homeowners. The Tripp system, therefore, is subject to inherent errors in measuring the moisture content of the soil that can cause either excessive watering of a localized area, erosion or underwatering which produces the localized foundational stress that causes structural damage.

The present invention overcomes those problems and other problems by replacing the moisture content sensors used in conventional foundation stabilization systems with specialized stress sensors. The sensors of the present invention are specifically designed to measure foundation stress resulting from the expansion or contraction of underlying soil based on moisture content. The system of the present invention introduces water into either all of the surrounding soil or specifically into localized areas until the force exerted on the foundation is equalized and at the proper level. The stress sensors of the present invention provide a much more accurate means of controlling soil movement. The prevention of damaging soil movement beneath a foundation, and the maintenance of soil stability when the foundation is positioned in a desirable manner are the ultimate aims of a foundation watering system. The present invention delivers into foundation soil variable amounts of water in a quantity sufficient to maintain the desired foundation alignment. In so doing, the problems of moisture measurement in soil and the complexities of weather prediction are bypassed. Highly precise strain gauges are placed at various locations about a foundation to sense foundation loads. In response to changes in foundation stress as measured by the strain gauges, water is precisely delivered to the various locations in order to maintain ideal loads.

SUMMARY OF THE INVENTION

It is an object of the present invention to provide a system for maintaining a constant level of moisture in the soil supporting the foundation of a house or building such that the addition or depletion of water by environmental conditions will not cause the soil to expand or contract, causing damage to the foundation it supports.

It is a further object of the present invention to provide a sensing means to detect the stress applied to a foundation by expansive soil.

It is another object of the present invention to continuously monitor foundational stress so that if that stress drops below a calibrated level, water will be injected into the soil surrounding the foundation to prevent torquing of that foundation by uneven stresses.

It is yet another object of the present invention to provide a soil moistening system that counteracts localized deprivation of water.

It is also an object of the present invention to provide a soil moistening device that is fully automatic and does not require the attention of the owner of the property.

It is still another object of the present invention to provide a device that can be easily installed for either a new foundation or a foundation of an existing home.

It is yet another object of the present invention to provide a system that is inexpensive to install.

Many other features, objects, advantages and details of the present invention will be apparent from the following detailed description of a preferred embodiment of the invention, particularly when considered in light of the prior art and in conjunction with the appended claims and the accompanying drawings.

DETAILED DESCRIPTION OF THE PREFERRED EMBODIMENT

Figure 1:
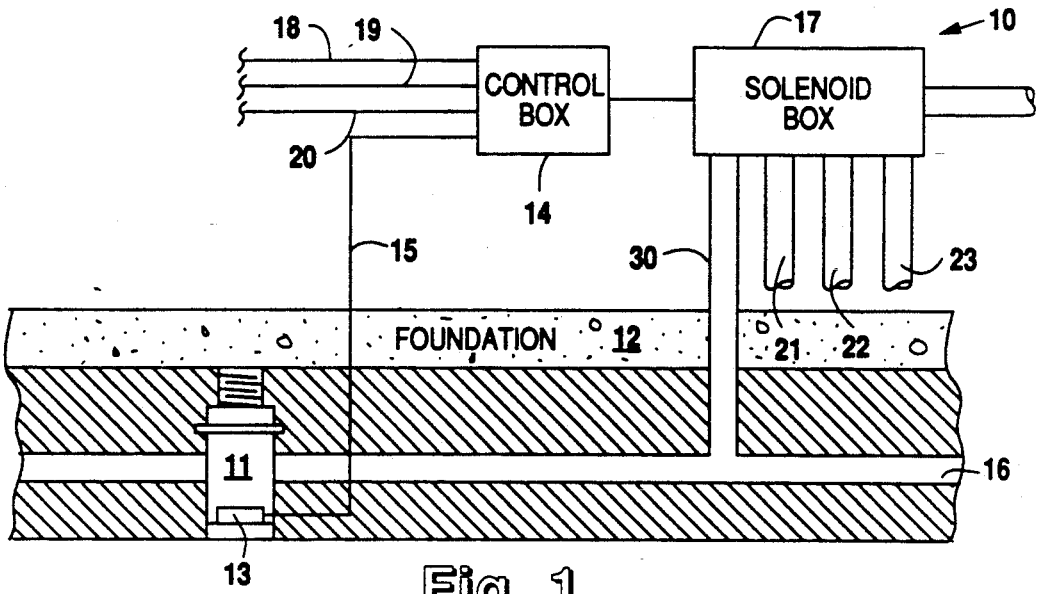
FIG 1*a* illustrates a soil moistening system pursuant to the present invention showing the positioning of the sensor and porous pipe under a foundation and a portion of the control system, specifically, the control box and solenoid box.
FIG. 1*b* illustrates the present invention surrounding a typical foundation and showing a possible placement for the stress sensors and porous pipe to create the watering zones.
Figure 1B:
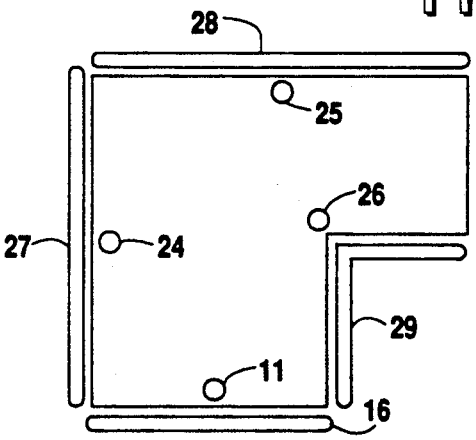

Referring to FIGS. 1*a* and 1*b*, an overview of the installation and apparatus of foundation stabilization system 10 will be discussed. Stress sensor 11 is positioned under foundation 12 with strain gauge 13 being connected to control box 14 through wire 15. Porous pipe 16 is buried under or adjacent the foundation and fluidly connected to a main water source (not shown) through fluid connector 30 routed through solenoid box 17. Control box 14 is electrically connected to solenoid box 17 to turn the water on and off through solenoids (not shown) in solenoid box 17.

Electrical wires 18, 19 and 20 are connected to remaining stress sensors 24, 25 and 26 (FIG. 1*b*) positioned about the foundation. Pipes 21, 22 and 23 are the fluid connections to porous pipes or sections 27, 28 and 29 positioned about the foundation as shown in FIG. 1*b*. For the purposes of a preferred embodiment, four stress sensors 11, 24, 25 and 26 and porous pipes or sections 16, 27, 28 and 29 creating four zones for watering are disclosed, however, one skilled in the art will recognize that any number of sensors and porous pipes or sections may be laid in various zones about the foundation to deliver sufficient amounts of water to ensure proper moisture content and prevent structural foundation damage.

Figure 2A:
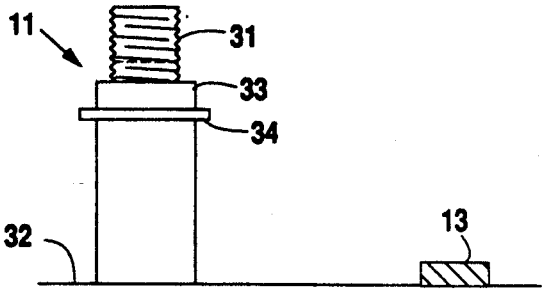
FIG. 2*a* is a side view illustrating a stress sensor according to the present invention.
Figure 2B:
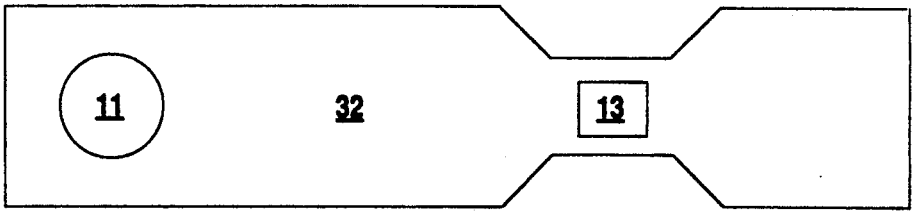
FIG. 2*b* is a top view illustrating a stress sensor according to the present invention.

Referring to FIGS. 2*a* and 2*b* the components and method of operation of a stress sensor 11 of the preferred embodiment of the present invention will be discussed. Base 32 is inserted under a foundation and provides support for threaded rod 31 and strain gauge 13. Rod 31 fits partially inside of base 32 and is held in place by the combination of a nut 33 and washer 34. Rod 31 is further threadably adjustable through the movement of nut 33 and therefore, may be adjusted to fit directly beneath the underside of a foundation. A suitable support for the stress sensor should preferably be provided. Strain gauge 13 is preferably of the directionally sensitive type which senses a drop in the vertical column portion of stress sensor 11 caused by the reduction of moisture in the soil lying underneath base 32. That motion is changed into a electrical signal which is used to control the addition of water to the zone of sensor 11. Strain gage 13 may further be equipped with a thermal compensation gauge (not shown) which compensates for any change in reading of strain gauge 13 caused by a change in temperature. The operation of strain gauge 13 to produce that signal will be discussed below with reference to the electrical control system.

Figure 3:
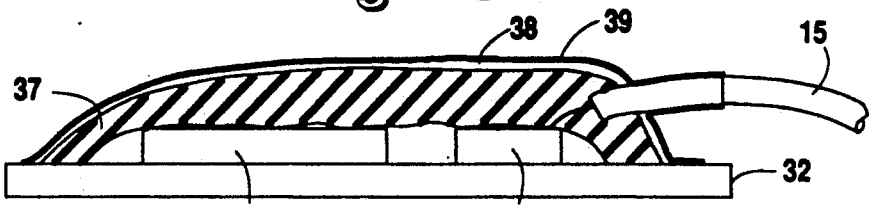
FIG. 3 is a cross-sectional view of a protective coating system according to the present invention for strain gauge.

With reference to FIG. 3, the protective coating for the strain gage will be discussed. After strain gage 13 is mounted on base 32 and lead wire 15 attached to terminal 36 which provides the electrical connection between strain gage 13 and the electrical control circuit, a layer of butyl rubber 37 is applied followed by a layer of aluminum tape 38. Lastly, a layer of nitrate rubber 39 is applied over the entire surface of the strain gauge. The purpose of the protective coating is to protect the strain gauge from water damage which would result in inaccurate readings.

Figure 4A:
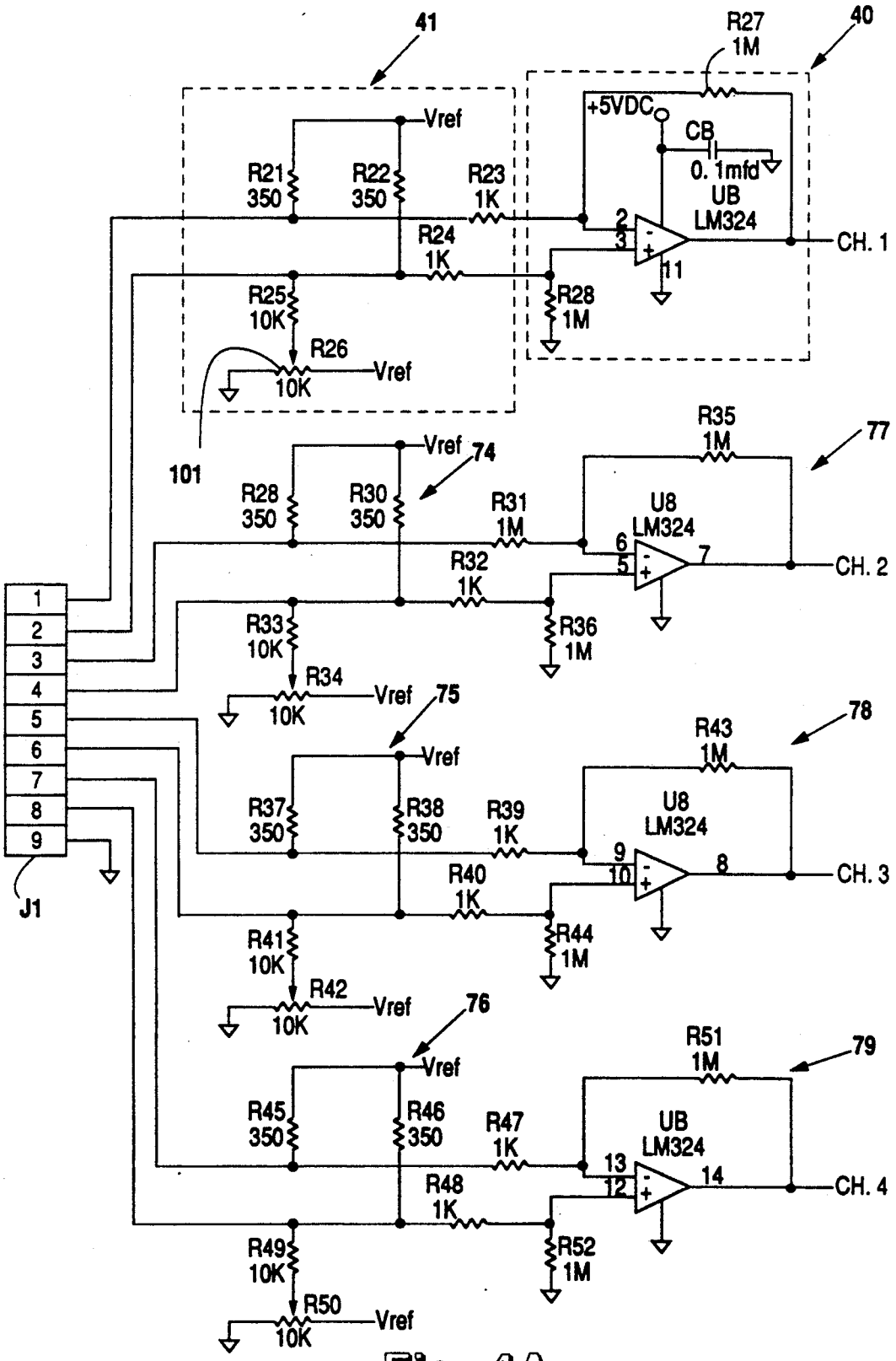
FIGS. 4*a*–4*g* are the schematical diagrams of the electrical control system.
Figures 4B, 4C:
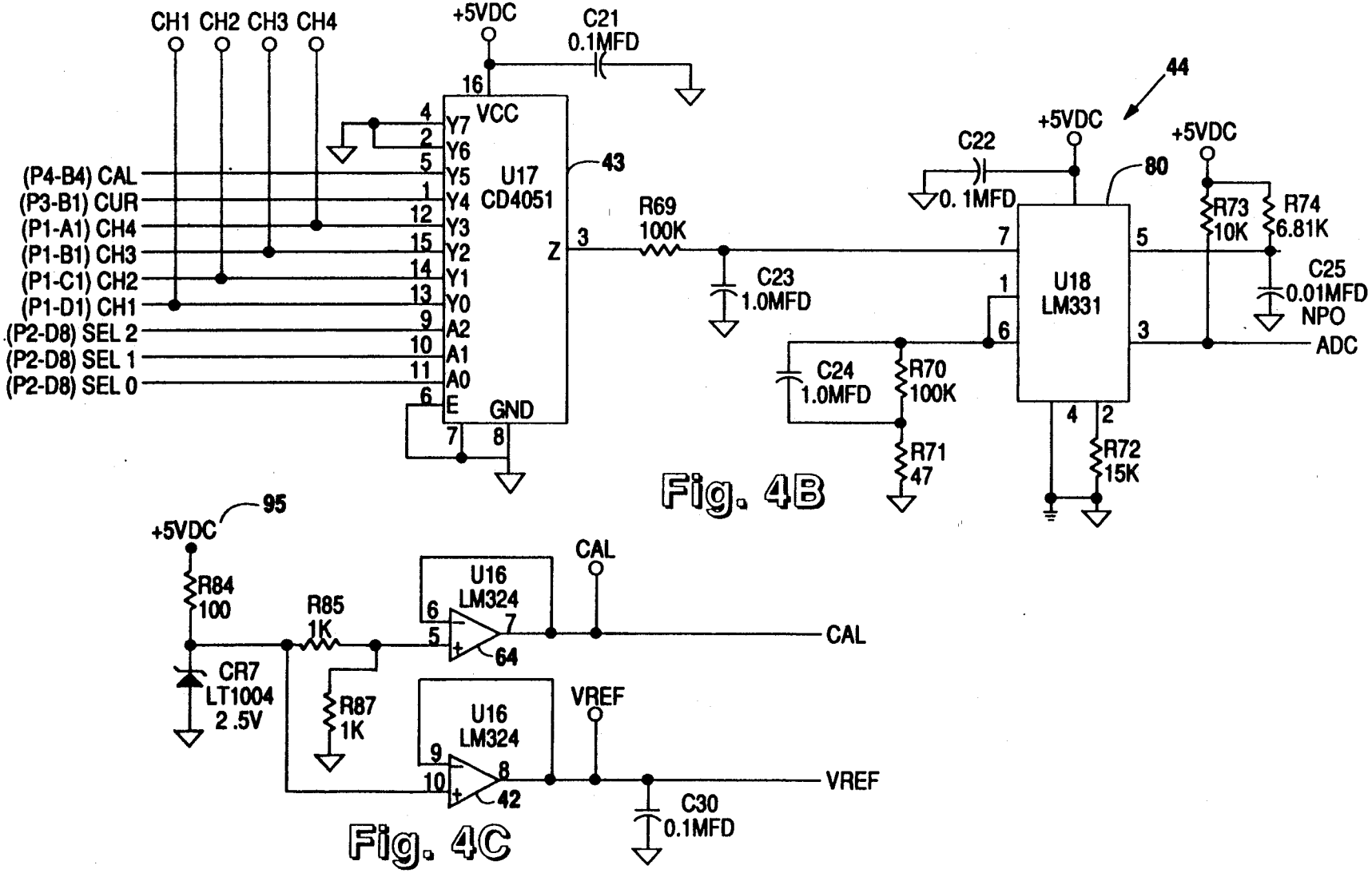

With reference to FIG. 4*a*, the operation of stress sensor 11 will be discussed. As the soil underneath stress sensor 11 shrinks away from the vertical column portion of stress sensor 11, a minute motion occurs which is sensed by strain gauge 13 (see FIG. 1*a*). Terminal 36 of strain gauge 13 is connected to Wheatstone bridge 41 and strain amplifier 40 through electrical connector J1. When the foundation is level, the resistance of strain gage 13 is such that Wheatstone bridge 41 is balanced and the output on channel 1 from strain amplifier 40 is a constant level which represents a level foundation. However, when the vertical column portion of stress sensor 11 shrinks away from foundation 12, the resistance of strain gage 13 decreases which unbalances Wheatstone bridge 41. That unbalance changes the input signal to strain amplifier 40 in proportion to the amount of unbalance. The input signal is amplified by strain amplifier 40 and output on channel 1 as a signal representing the amount of soil shrinkage. Wheatstone bridge 41 is provided with a reference signal, VREF, used to balance the bridge through potentiometer 101 when the foundation is level. VREF is a 2.5 volt signal generated as shown in FIG. 4*c*. Five volt DC source 95 is limited by zener diode CA7 to 2.5 volts. That 2.5 volt signal is buffered through amplifier 42 and output as VREF. For the purposes of discussion, only one stress sensor operation was discussed, however Wheatstone bridges 74, 75 and 76 and strain amplifiers 77, 78 and 79 operate in exactly the same fashion as above and output signals representative of soil shrinkage from the remaining three stress sensors. Furthermore, one skilled in the art will readily recognize that any number of stress sensor circuits could be constructed to monitor additional zones.

Referring to FIG. 4*b*, the signals from each of amplifiers 40 and 77–79 are output to multiplexer 43 where, based upon the logic generated by microcontroller 45 (FIG. 4*d*) and output to multiplexer 43 over select lines 0–2 (see Table 1), one of the four channels or the CUR or CAL signal (discussed herein) will be sent to A to D converter 44. In the preferred embodiment, A to D converter 44 uses voltage controlled oscillator 80 to produce a signal with a frequency having a rate proportional to the applied voltage from multiplexer 43 which is output to an interrupt on microcontroller 45 (see FIG. 4*d*) over line ADC.

Again referring to FIG. 4*c*, the 2.5 CAL signal will be discussed. The 2.5 volt signal is generated in exactly the same method as the 2.5 VREF signal except that amplifier 64 is used as a buffer. The CAL signal is applied to the multiplexer 43 and during initialization of the entire system it is selected by microcontroller 45 and used as a known voltage reference signal to calibrate voltage controlled oscillator 80.

TABLE 1

| CT LOGIC | SELECTED SIGNAL |
|---|---|
| 000 | CH 1 |
| 001 | CH 2 |
| 010 | CH 3 |
| 011 | CH 4 |
| 100 | CUR |
| 101 | CAL |

Figure 4D:
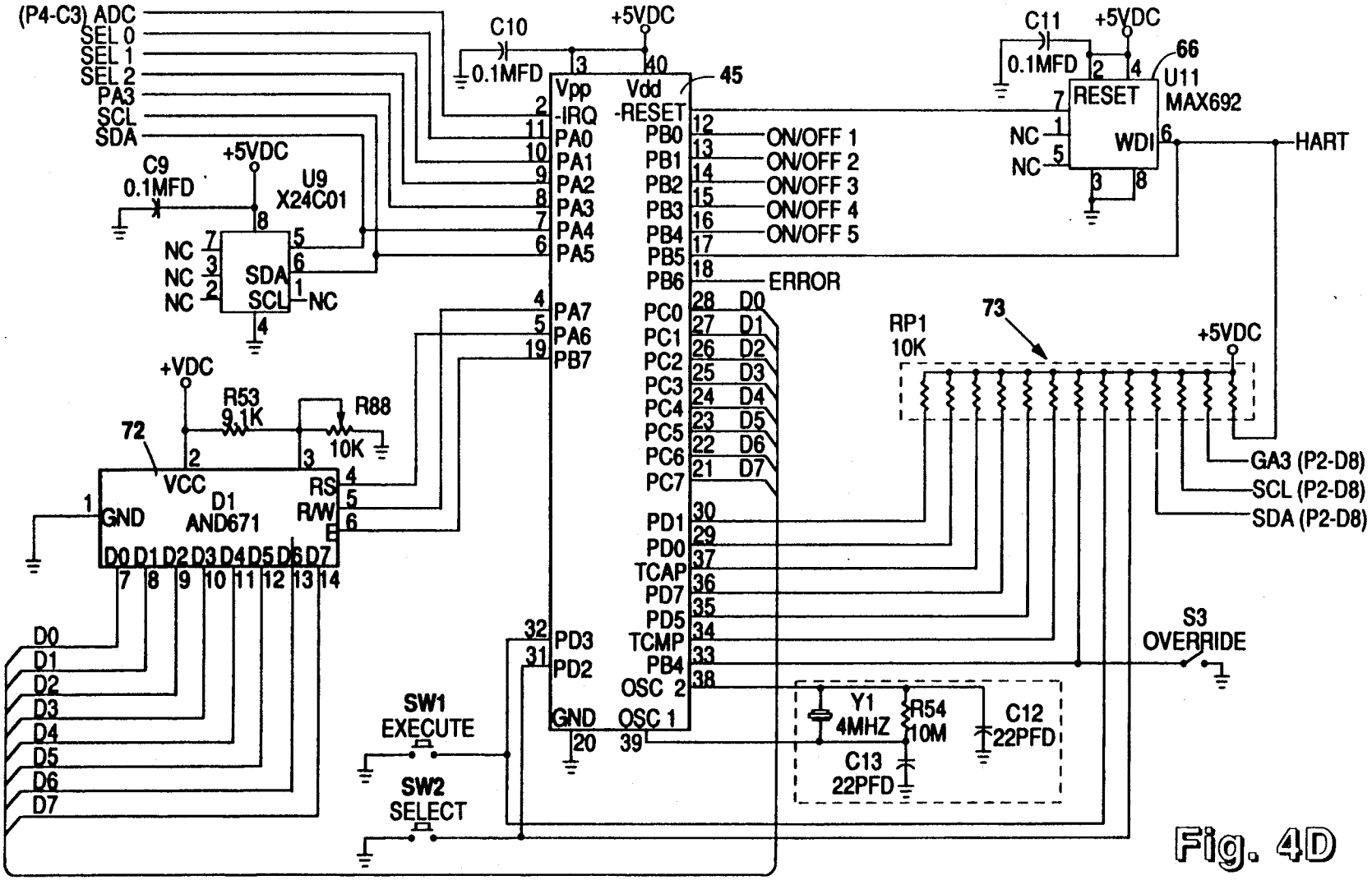

Microcontroller 45 is programmed to count the number of interrupts over a predetermined period (one second in the preferred embodiment) to determine the frequency of the signal sent over line ADC and thereby, determine the voltage because of its proportionality to the frequency. That measured voltage signal, which represents the stress being applied against the foundation, is compared with a set point, which represents the stress applied against the foundation when the foundation is level, and is stored in EEPROM 46 (FIG. 4*d*). If the measured signal is less than the stored set point, then soil shrinkage has occurred and water must be added to the particular zone. Microprocessor 45 is programmed to send a signal is then sent over one of ON/OFF lines 1 through 4 to turn on the appropriate solenoid and water the correct zone.

Figure 4E:
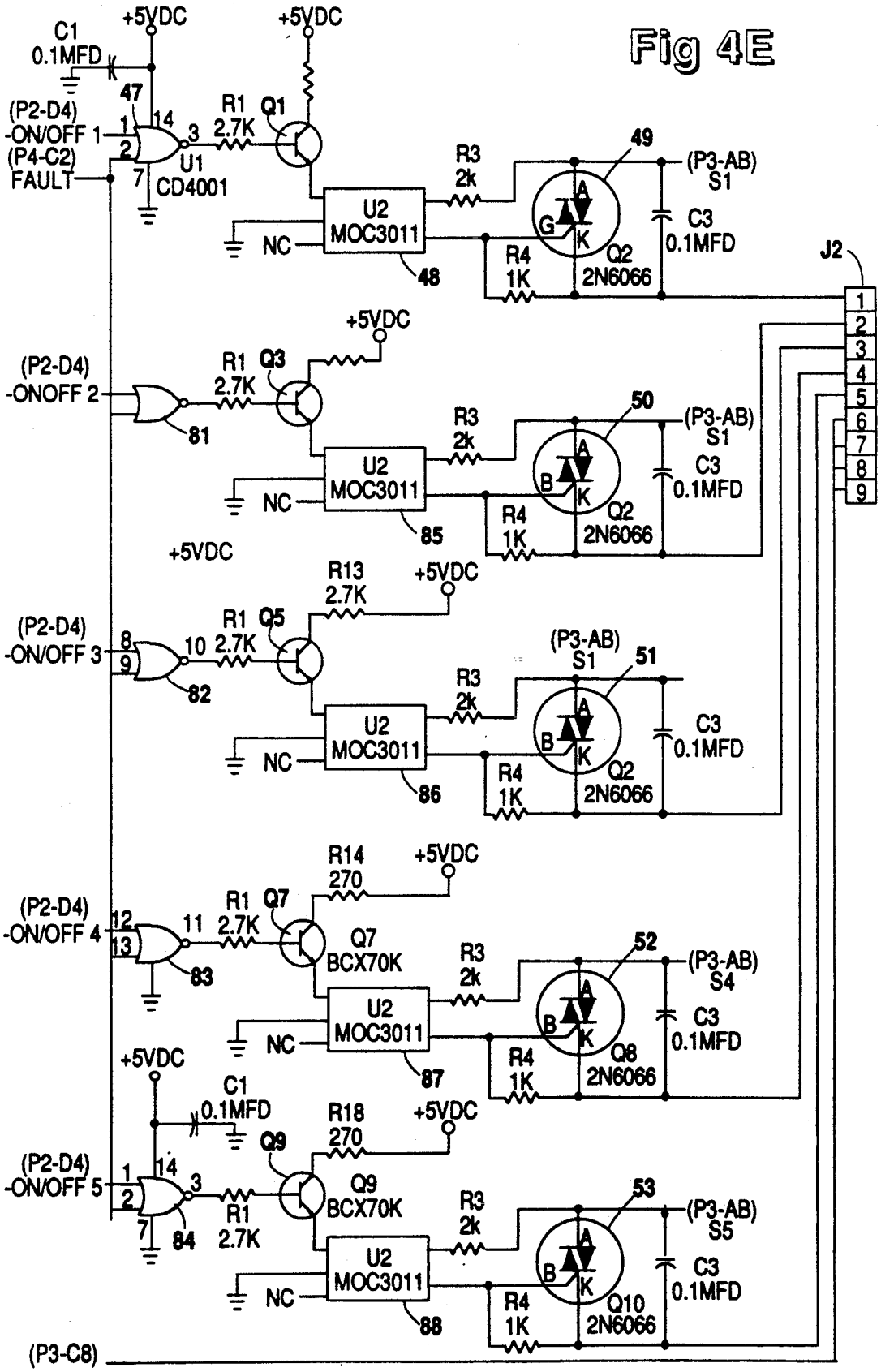
Figure 4F:
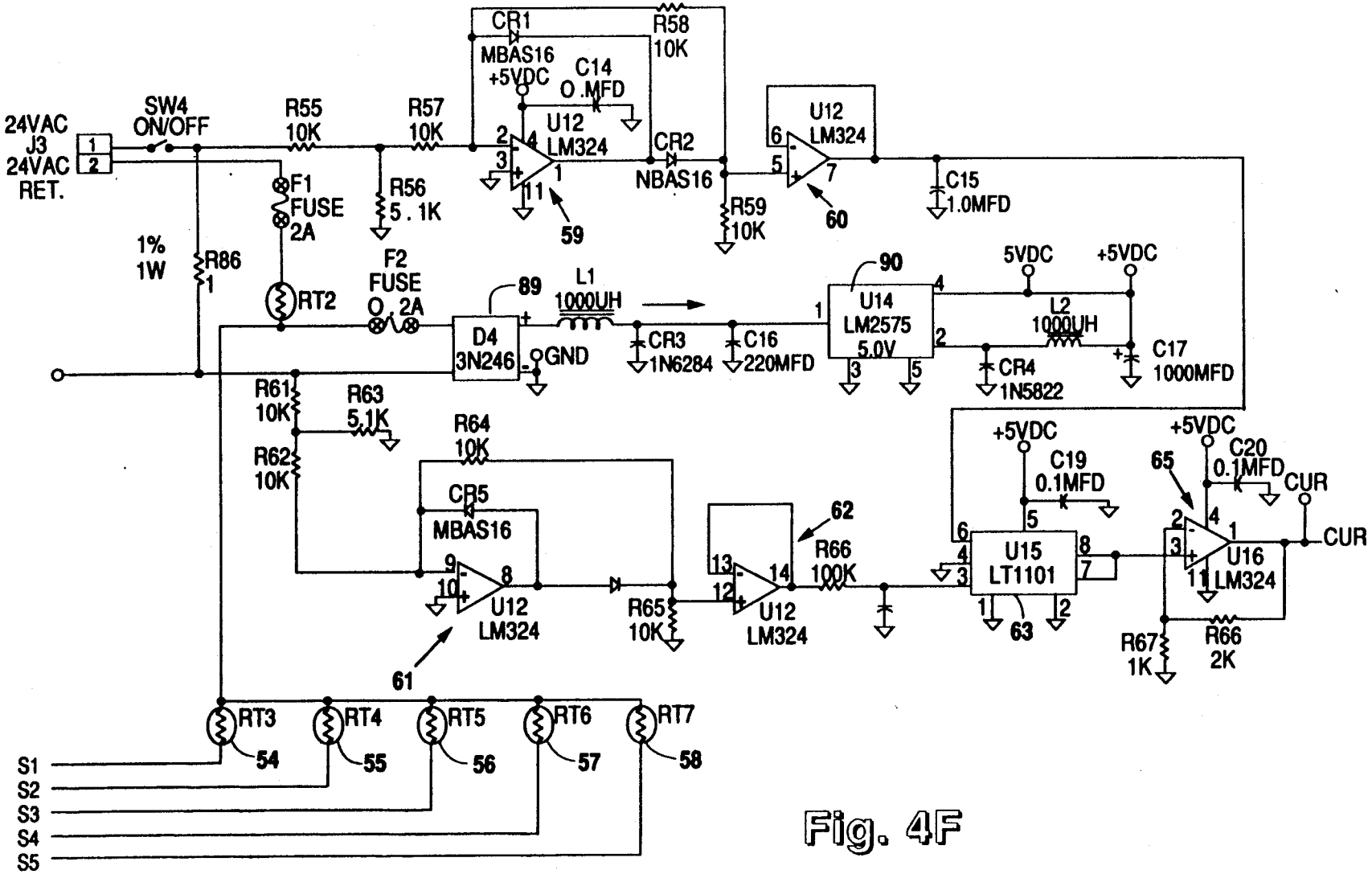

Referring to FIG. 4*e*, the solenoid operation will be addressed. By way of example, if zone 1 is selected, microcontroller 45 will set −ON/OFF line 1 low. NOR gate 47 is used to prevent the solenoid from being turned on if it is faulty or if there is a system malfunction. As long as the system is functioning properly, the FAULT signal (generation of the FAULT signal will be discussed herein) remains low and therefore, the output of NOR gate 47 to transistor Q1 will be high. The output from transistor Q1 is used by optoisolater 48 to drive SCR (silicone controlled rectifier) 49 which is used to switch a 24 VAC source (not shown) to the solenoid under its control. SCR's 50–52 operate the remaining three solenoids to deliver water to their respective zones, however, SCR 53 operates a fail safe solenoid (not shown) which closes a valve (not shown) to shut off the main water to all four zones in the event of a malfunction such as a solenoid being stuck open. The operation of NOR gates 81–84, transistors Q3, Q5, Q7 and Q9 and SCR's 85–88 are the same as described above. Also in the circuit between SCR's 49 through 53 and the 24 VAC source are thermistors 54 through 58 (FIG. 4*f*). Thermistors 54 through 58 act as buffers between the 24 volt AC source and the solenoids to provide protection against fire.

Referring to FIG. 4*f*, the electronic control system power supply will be discussed. The 24 VAC power supply (not shown) is applied across bridge rectifier 89 and then to switching power supply 90 which converts the 24 VAC signal to a 5 VDC signal. That 5 VDC signal is then used to power microcontroller 45 and its associated circuitry.

Again referring to FIG. 4*f*, a further fail safe feature will be discussed. The current delivered to the selected solenoid is monitored by microcontroller 45. To measure the current applied to the solenoids for diagnostic purposes, the voltage drop across resistor R86 is converted to a DC signal by amplifiers 59 through 62 which are used as precision rectifiers. The DC signal is then input into instrumentation amplifier 63 which converts the differential rectified signal to single ended which is then amplified by amplifier 65 and sent to multiplexer 43 over the line marked CUR. Microcontroller 45 periodically outputs the CUR select logic (see Table 1) over select lines 0–2 to multiplexer 43 which then outputs the CUR signal to A to D converter 44. The CUR signal is converted to digital and read by microcontroller 45. That signal, which represents solenoid current, is then processed by microcontroller 45 to determine if the solenoid is drawing too much current or no current at all. In either instance, microcontroller 45 generates an error signal over the ERROR line (discussed herein) which will turn off the entire system.

Figure 4G:
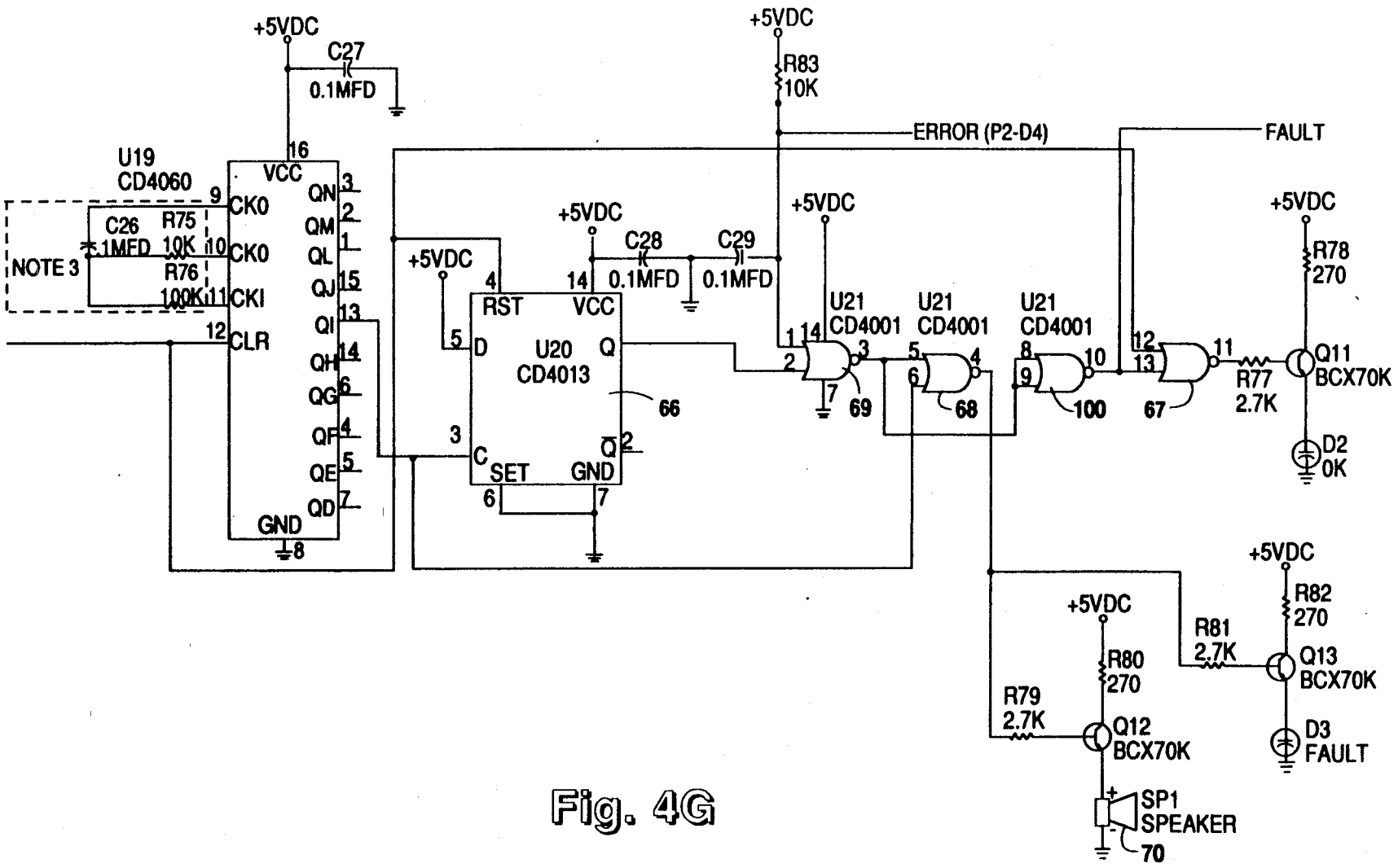

Referring to FIGS. 4*d* and 4*g*, the monitoring and fail safe system will be discussed. "Watchdog" timer 66 serves to monitor the 5 volt line and the HART signal generated by microcontroller 45 and to reset the system if there is an error. The HART signal is a toggle signal, namely a pulse train, input into the clear pin of a second "watchdog" timer 67 (FIG. 4*g*) used to continually reset that timer. Also, during normal operation, the HART signal is input into NOR gate 68 causing lamp D2 to flash denoting proper system operation. However, if the microcontroller malfunctions, the HART signal ceases to be generated and becomes low. Therefore, watchdog timer 67 is not reset and subsequently times out. When that occurs, watchdog timer 67 outputs a low signal which is latched by flip-flop 69 causing it to change state. The Q pin of flip-flop 69 goes high resulting in a low signal being output from NOR gate 70. That signal is input into NOR gate 100 causing it to output a high signal. The output of NOR gate 100 is input with the HART signal (now low) into NOR gate 68, the output of which turns off light D2. The output of NOR gate 70 is also input along with the output of "watchdog" timer 67 into NOR gate 71 resulting in a high output. That output is used to beep speaker 72 and light lamp D3 denoting a system malfunction.

As an additional fail safe, microcontroller 45 monitors the system through diagnostic signals such as CUR, and upon the detection of an error outputs an error signal over the line marked ERROR (FIG. 4*d*). While the system is functioning properly, the error signal input from microcontroller 45 into NOR gate 70 remains low. However if the microcontroller detects a system error, that signal will go high causing NOR gate 70 to output a low signal. Also in response to an error, the microcontroller will turn off the HART signal causing "watchdog" timer 45 to output a low signal as described above. The outputs of "watchdog" timer 67 and NOR gate 70 are input into NOR gate 71 resulting in a high output. That output is again used to beep speaker 72 and light lamp D3. The output of NOR gate 70 is input into NOR gate 100 causing it to output a high signal. That signal is input into NOR gate 68 with the HART signal to ultimately turn off lamp D2 as previously described.

On any system error, all the solenoids will be turned off. That occurs because the FAULT signal, generated by the output of NOR gate 100, changes to a high output causing NOR gates 47 and 81–84 shown in FIG. 4*e* to output low signals, thereby, removing all power from the solenoids and stopping system operation.

Again referring to FIG. 4*d*, system calibration and manual control will be discussed. LCD display 72 is used to display the menu options available to a system operator. A system operator presses select switch SW2 to display the menu options and presses the execute switch SW1 to execute those options. The menu options are: calibrate the entire system; calibrate each sensor individually; read actual stress sensor measurements individually; retrieve set point data and turn on each individual solenoid. A system operator wishing to turn on an individual solenoid presses execute switch SW1 which causes microcontroller 45 to output a signal on the selected -ON/OFF line and the individual solenoid is turned on as discussed above with reference to automatic operation. To calibrate the entire system execute switch SW1 is pressed when the calibrate entire system option is displayed on LCD 72. Initially, the moisture content of the clay soil is increased to its maximum amount. Microcontroller 45 then reads the present measurement of foundation stress measured by each sensor at that maximum amount and stores that measurement in EEPROM 46 to serve as the set point data representing a level foundation. The bank of resistors denoted by numeral 73 are used as pull up resistors to increase the current outputted from microcontroller 45 to levels necessary for proper system operation.

Figure 5:
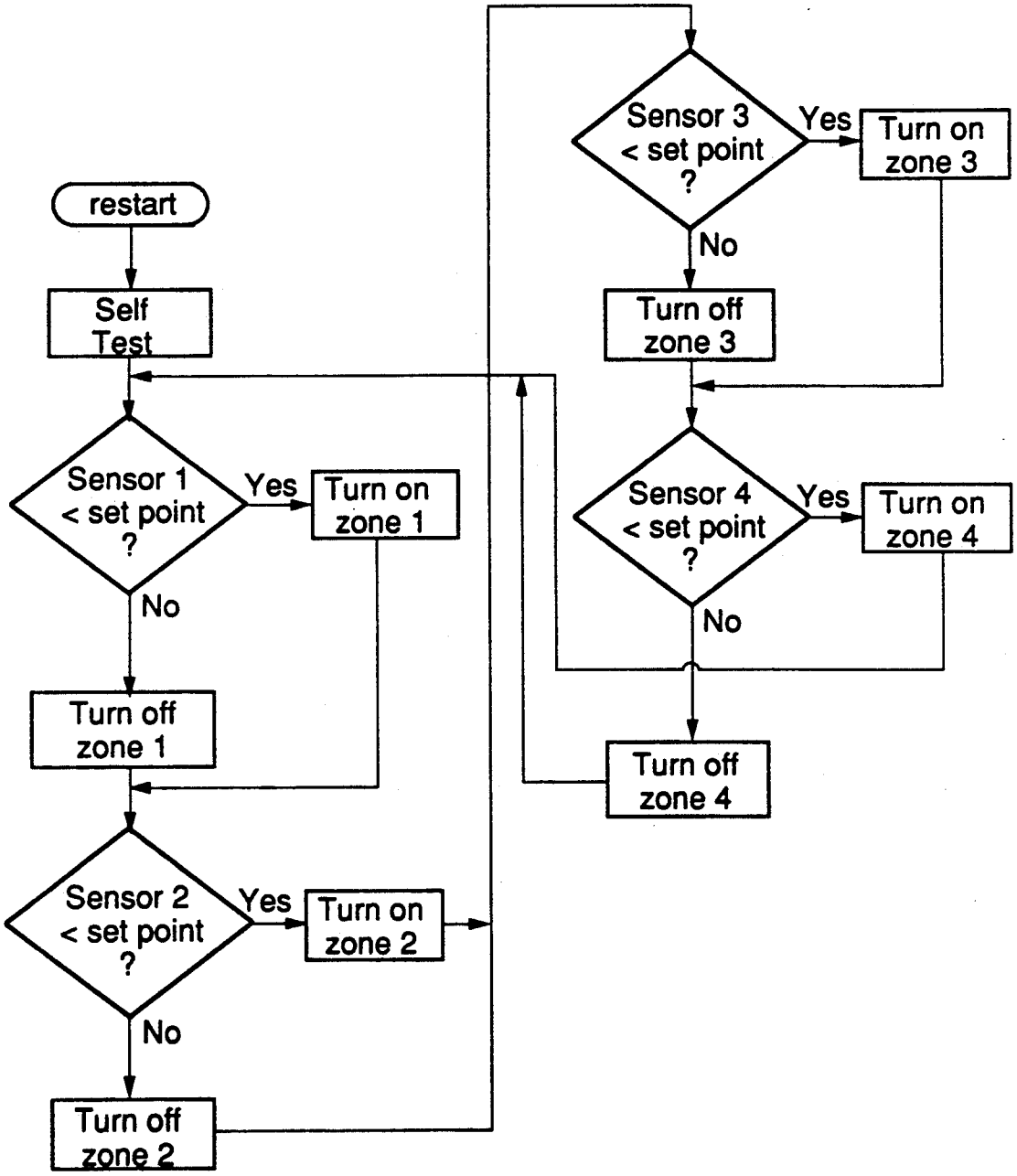
FIG. 5 is a flow chart showing system operation.

Referring to the flow chart of FIG. 5, automatic system operation will be discussed. After the system is restarted, a self test is run. Microcontroller 45 then compares the measurement of sensor 1 with the set point for that zone, determined as described above. If that measurement is less than the set point, meaning that the soil in zone 1 has lost moisture, then the water is turned on and left on until sensor 1 registers proper foundational pressure. Microcontroller 45 next compares the measurement of sensor 2 with its set point and turns zone 2 on or off accordingly. Sensor 3 is then checked and zone 3 is turned on or off, and finally sensor 4 is checked and zone 4 turned on or off. Microcontroller 45 then returns to check sensor 1 and the process repeats. Microcontroller 45 will continually monitor each zone and add water to stabilize the soil moisture content and prevent structural foundation damage unless there is a system malfunction as discussed above.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly is not to be limited in any respect by the foregoing description, rather, it is designed only by the claims which follow.

What is claimed is:

1. A soil moisture content control apparatus for stabilizing structural foundations comprising:

stress sensing means placed in a plurality of zones surrounding said foundation for producing an electrical signal representing the stress exerted against said foundation;

a water delivery means; and a control means in communication with said sensing means and operatively connected to said water delivery means to regulate water flow in response to said electrical signal received from said stress sensing means.

2. The apparatus of claim 1 wherein said stress sensing means comprises:

a base;

a rod mounted on said base wherein said rod is treadably adjustable; and a strain gauge mounted on said base for measuring the stress applied to said rod.

3. The apparatus of claim 2 wherein said strain gauge comprises:

a thermal compensation gauge;

a resistive change measuring means wherein said change in resistance represents the stress applied to said rod; and amplification means for converting said resistance change into said electrical signal.

4. The apparatus of claim 1 wherein said control means comprises a microcontroller.

5. The apparatus of claim 4 wherein said control means further comprises:

a calibration means; and memory means for storing calibration data which represents the stress applied to said stress sensing means when said foundation is level.

6. The apparatus of claim 5 wherein said control means further comprises a multiplex means for selecting which signal from a plurality of stress sensing means is to be processed.

7. The apparatus of claim 6 wherein said control means further comprises an analog to digital conversion means to convert said electrical signal.

8. The apparatus of claim 7 wherein said control means further comprises solenoid control means operatively connected to a power supply and controlled by said microcontroller to turn on and off said water delivery system using a solenoid bank.

9. The apparatus of claim 8 wherein said control means further comprises means for allowing a system operator to control system calibration and operation.

10. The apparatus of claim 9 wherein said control means further comprises system display means.

11. The apparatus of claim 10 wherein said control means further comprises a reset means.

12. The apparatus of claim 11 wherein said control means further comprises system failure control means.

13. The apparatus of claim 12 wherein said system failure control means comprises:

means for monitoring current delivered to said solenoid bank to determine if any solenoid is drawing too much current or no current at all;

means for monitoring said microcontroller; and means responsive to said current and microcontroller monitoring means to turn off said solenoid bank and reset said control means.

14. The apparatus of claim 1 wherein said water delivery means comprises:

a main water source; and a plurality of porous pipe buried underneath and surrounding said foundation in zones and connected to said main water source wherein each zone may be controlled separately to deliver water to the soil underneath said foundation.

15. A method of controlling soil moisture content to prevent structural foundation damage comprising the steps of:

measuring the stress applied against said foundation at a plurality of zones;

converting said measured stress data to an electrical signal;

comparing said measured stress data with calibration data for each of said zones;

delivering water to any zone where said measured and calibration data do not correspond.

16. The method of claim 14 further including the step of determining the calibration data for each zone comprising the steps of:

increasing the soil moisture content in said plurality of zones to a maximum level;

measuring the stress applied against said foundation when the soil moisture content is at a maximum; and using said measurement as a representation of when said foundation is completely level.

* * * * *